United States Patent [19]

Wandel et al.

[11] 4,157,276

[45] Jun. 5, 1979

[54] PAPER MACHINE FABRIC IN AN ATLAS BINDING

[75] Inventors: Hermann Wandel; Fritz Bleher, both of Reutlingen, Fed. Rep. of Germany

[73] Assignee: Hermann Wangner, Reutlingen, Fed. Rep. of Germany

[21] Appl. No.: 674,817

[22] Filed: Apr. 8, 1976

[30] Foreign Application Priority Data

Apr. 18, 1975 [DE] Fed. Rep. of Germany ..... 2517228

[51] Int. Cl.[2] ..... D21F 1/10

[52] U.S. Cl. ..... 162/348; 139/425 A; 162/DIG. 1; 428/258

[58] Field of Search ..... 162/348, DIG. 1; 139/425 A; 428/257, 258

[56] References Cited

U.S. PATENT DOCUMENTS 3,421,230 1/1969 Ward ..... 139/425 A

*Primary Examiner*—Richard V. Fisher

*Attorney, Agent, or Firm*—Scully, Scott, Murphy & Presser

[57] ABSTRACT

A fabric for a paper machine including warp and weft threads in an atlas binding providing for improved longitudinal and transverse stability. The uppermost points of the warp and weft threads in the direction towards a paper-supporting surface on the fabric are located in substantially a single plane so as to obtain more uniform marking properties for the fabric and to concurrently avoid material deposits thereon.

3 Claims, 2 Drawing Figures

PAPER MACHINE FABRIC IN AN ATLAS BINDING

FIELD OF THE INVENTION

The present invention relates to a fabric for a paper machine and the utilization thereof in the wet end section.

Heretofore employed as bindings for paper machine fabrics have been the simple canvas binding, the twill binding (3-and 4-twill fabrics), the double binding (double fabrics), and the 2-and 3-warp binding.

The selection of a certain type of binding, in the first instance, depends upon the type of paper which is to be produced, and upon the circulating characteristics of the fabrics. An important disadvantage which is encountered in many types of bindings, in particular when utilized for plastic material fabrics, consists of the fabrics expanding on the paper machine after a certain wire life, which may then run in ridges. Furthermore, the type of binding which is employed influences the wire life of the fabric.

SUMMARY OF THE INVENTION

Accordingly, it is an object of the present invention to provide a fabric or screen for a paper machine which evinces a high longitudinal and transverse stability, and thus provides a lengthy circulating period.

The foregoing object is inventively attained in that the paper machine fabric possesses an atlas binding.

A further object of the invention lies in the utilization of an inventive paper machine fabric which is employed in the wet end as a warp runner for the production of tissue and similar papers on tissue machines and for the manufacture of printing paper, as well as a weft runner for production of Kraft paper and test liner on a sulfate basis and packing paper which is based on a Kraft pulp material and facilitating the wet batching or passage of the wet paper through that section of the machine.

In an atlas binding, the connecting or binding points are uniformly distributed and do not contact each other. In the textile technology, atlas bindings are thus frequently preferred since the upper surface and the lower surface of the weave possess different appearances; for example, the upper surface of the weave may have a matted or dull appearance imparted thereto through respective warp threads, whereas the lower surface of the weave may be provided with a shiny appearance through the use of high-shining weft threads.

However, it is also known from textile technology that an atlas weave is not as rigid or stable in form as a weave formed by other bindings, since the connecting or binding points do not contact in an atlas weave, i.e. compare "Grundlagen der Gewebetechnik" VEB Fachbuchverlag Leipzig, Second Edition, 1968, page 50, Numeral 3.4.1. This knowledge obtained in textile technology has, apparently, transmitted itself to the manufacture of fabrics for paper machines. In the special publication "Das Wangnersieb", 1966, page 29, it appears that, for example, a 5-shed twill fabric (atlas is at least a 5-shed binding) is viewed as not being suitable for endless metal wires used in paper manufacture. In general, it has been assumed that, as a result of the high longitudinal and cross stability which is required for a paper machine fabric, an atlas binding is not suitable and provides for lower circulating or operating periods as compared with other bindings having a comparable open cross-section.

Respecting the terminology as employed herein, it is to be noted that in the English language a twill weave is designated as a "Satin Weave" (compare Kunststofftechnisches Worterbuch by A. M. Wittfooht, 1961, Third Edition, Volume 1, page 100, left column); thus "Satin" is not in all instances synonymous with "atlas" since a satin weave may also encompass a four shed weave, whereas an atlas weave does not.

However, the applicants were able to determine that an atlas paper machine fabric, notwithstanding its loose binding or connection, possesses an excellent longitudinal and transverse stability, will not throw ridges on a paper machine, and will also not displace towards one side. For example, it has been ascertained that the transverse contractions in an atlas paper machine fabric are about 30% lower than in an otherwise identical twill paper machine fabric.

In contrast with all conventional twill fabrics, in an atlas fabric there is no diagonal line and no twinning effect in the warp and/or weft. Designated hereby by "warp" are the threads lying in the paper machine so as to extend in a longitudinal direction, and by "weft" there are designated the threads lying in the paper machine so as to extend in a transverse direction. In particular, for flat-woven 4-shed twill- (cross-twill) fabrics, a twinning formulation is created through the pairwise position of the threads. In a monoplane atlas paper machine fabric, meaning, in an atlas paper machine fabric in which the uppermost points of the warp and weft in the direction of the paper-supporting side lie approximately in a single plane, there are obtained particularly advantageous, namely, more uniform marking properties, and material deposits in the fabric are avoided.

A coating of paper machine fabrics which are in atlas binding by means of various separating agents, in a further enhanced measure reduces any material deposits comprising of soiling substances from the paper slurry. Evaluated as particularly advantageous exemplary embodiments have been coated paper machine fabrics in which the coating is comprised of a fluorocarbon resin covering.

The loose binding of the atlas, which until now has been viewed as disadvantageous, has been ascertained to be particularly advantageous in actual practice inasmuch as it provides a relatively larger mesh opening whereby the specific water drainage capacity or dehydrating output (dehydrating output/surface unit) is improved by about 11% as compared with a twill binding.

When a higher drainage capacity or dehydrating output is not necessary, then for an atlas paper machine fabric, as contrasted with a conventional 3- or 4-twill paper machine fabric having an identical fabric mesh number, there may be employed a higher weft number or heavier weft threads. Hereby, for purposes of abrasion there thus are available a larger volume of threads, which results in a longer running time.

Moreover, the mesh number can also be reduced. A 4-twill fabric having the mesh number 71/mesh (=28/cm) with a warp diameter of 0.20 millimeter, a weft count of 22 and a weft diameter of 0.25 millimeter, for instance, possesses the same specific drainage capacity or dehydrating output as an inventive atlas fabric having the mesh number 26 with a warp diameter of 0.22 millimeter, a weft count of 22 and a weft diameter of 0.27 millimeter.

As a result of the higher specific drainage capacity, the vacuum employed at the flat suction boxes of the paper machines can be lower for atlas fabrics. Hereby there is felt the effect of the more advantageous retention relationship which is possessed by atlas fabrics as a result of their more uniform mesh configuration. The possibility that the vacuum at the flat suction boxes can be reduced also contributes to a lower extent of abrasion at the fabric, and additionally at the flat suction boxes.

Through the intermediary of the uniform mesh configuration, the flow of the water is improved so as to thereby obtain an improved paper structure (fiber orientation).

On paper machines, on which there are produced papers having extensively varying surface weights, it is often difficult to be able to operate with a single mesh number, since with a common plastic material fabric at the same retention performance there is often attained a lower drainage capacity than would be with a comparable metal wire. Due to the previously mentioned higher drainage capacity, this disadvantage which is encountered with a plastic material fabric is eliminated in an atlas binding.

Predicated on the previously mentioned advantages of an atlas paper machine fabric, this fabric is particularly suited for the manufacture of the following types of papers:

1. Cotton-wadding papers on tissue machines.

Herein, in view of the more uniform fabric construction, in actual practice there can be attained operating speeds of 1150 meters per minute. However, this speed does not represent an upper limit; in particular in the employment as a weft atlas (warp runner) it is possible to attain still higher operating speeds. 2. Printing papers and generally types of papers in which the marking through twin formation results in an inherent disadvantage.

Inasmuch as, for synthetic fabrics, the twinning or marking effect is obviated in an atlas binding a further field of application can thereby be ascertained for synthetic fabrics when, through a satisfactory combination of warp and weft thread diameters, there is provided an optimum compromise between stability and marking. This possibility results from the fact that at the same drainage capacity or dehydrating output, the weft density can be increased and the marking improved.

3. Packing papers (Kraft and test liners and corrugated medium).

In the manufacture of Kraft and test liners which are based on sulfate, as well as in the manufacture of packing papers and cartons (bag papers based on Kraft fiber material), as a result of the long-fibered structure of the paper material and the reduced material deposits, there are obtained more advantageous sheet formation properties on the paper machine. The same positive results are also attained during the manufacture of papers in which the waste-paper component consists primarily of fluting, or respectively, Kraft and test liner wastes (corrugated medium and crades with a high waste paper content). In this connection, the fabric is preferably utilized as a warp atlas (weft runner).

BRIEF DESCRIPTION OF THE DRAWINGS

Reference may now be had to the following detailed description of the invention, taken in conjunction with the accompanying drawings; in which.

DETAILED DESCRIPTION

Figure 1:
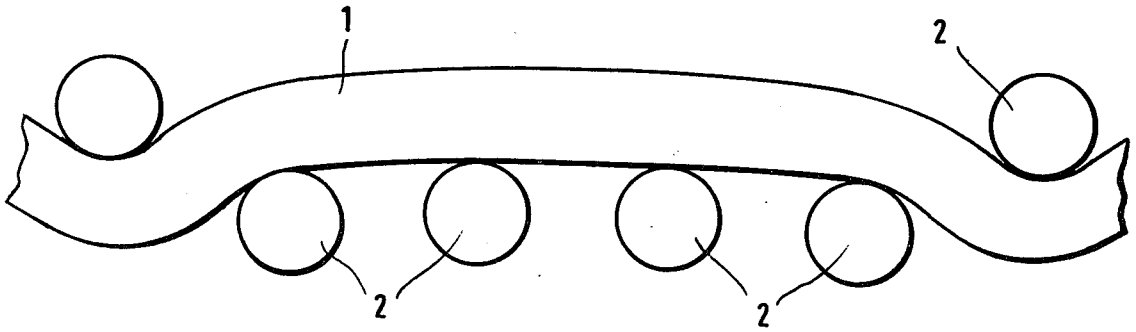
FIG. 1 shows a longitudinal section in parallel to the warp of a paper machine fabric in a five-shed atlas binding (warp atlas)

Referring in detail to the drawings, FIG. 1 shows a paper machine fabric in a longitudinal section extending parallel to the warp in a five-shed atlas binding (warp atlas). The warp thread 1 presently runs over four weft threads 2 and is then interengaged with a weft thread. The uppermost points of the warp and weft in the direction of the paper-supporting side generally lie in a single plane (monoplanarity), whereby the fabric is completely smooth on the upper surface thereof and, in particular, no raised points are present at the interengaging locations.

In the utilization thereof as a warp atlas, the paper is supported on the warp and the fabric runs on the weft (weft runner).

Figure 2:
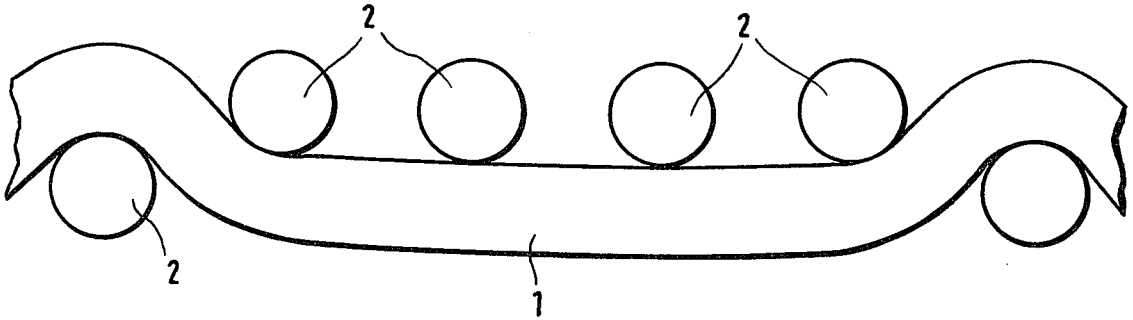
FIG. 2 shows a longitudinal section of the fabric in parallel to the warp in a five-shed atlas binding as a weft atlas.

FIG. 2 illustrates a paper machine fabric in a longitudinal section extending parallel to the warp in a five-shed atlas binding as a weft atlas. Four weft threads 2 extend presently over a warp thread 1. This warp thread 1 is then presently interengaged with the fifth weft thread. In this weft atlas, the uppermost points of the weft and warp in the direction of the paper-supporting side are also located in approximately a single plane (monoplanarity).

When employed as a weft atlas, the paper is supported on the weft and the fabric runs on the warp (warp runner). In such warp runs the warp threads, to a particular measure, are responsible for the operating or circulating period.

Figure 3:
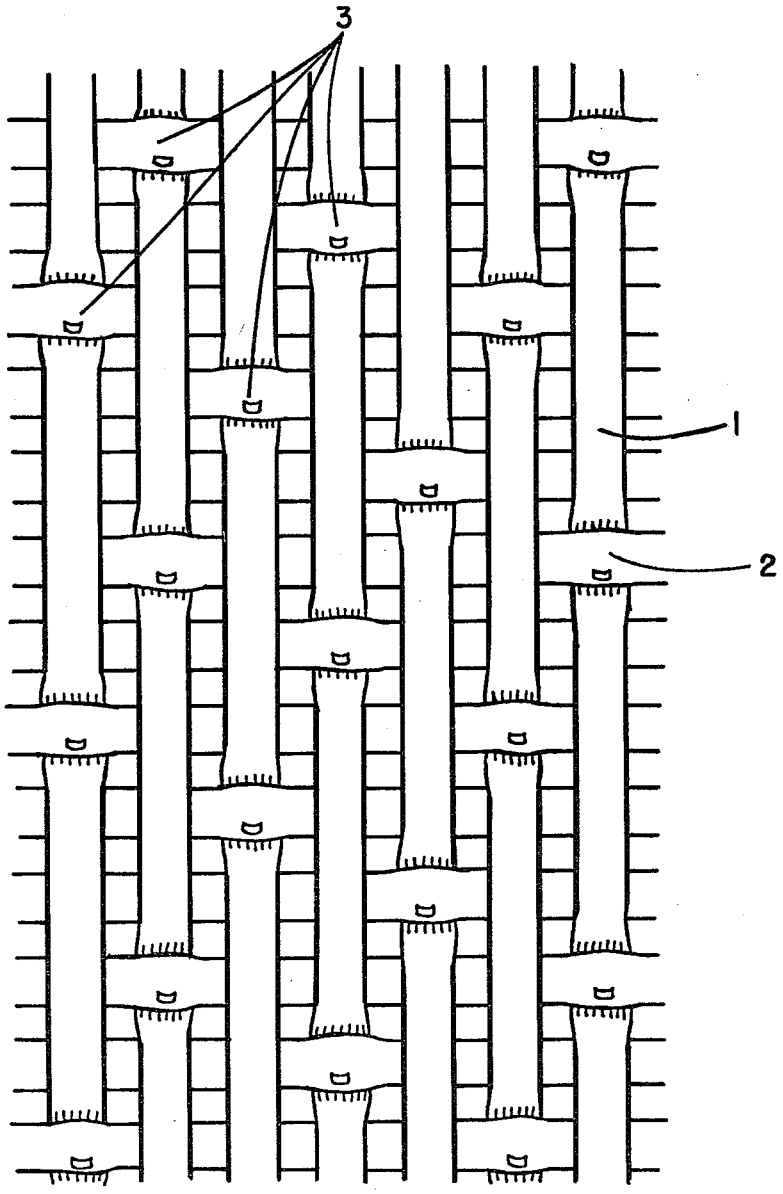
FIG. 3 shows a top plan view of a five shed atlas binding.

In FIG. 3 the binding points 3 are distributed uniformly and do not contact each other as is characteristic of an atlas binding. The atlas binding shown in FIG. 3 is five shed because every warp lies on top of four wefts and is led below the fifth weft. In the same way every weft lies on top of every fifth warp.

The possible utilization of thicker warp threads in an atlas paper machine fabric results in a higher degree of stability, and the utilization of thicker weft threads in a higher operating or circulating time in comparison with, for example, a four-twill fabric of equal water removing output capability.

With four and less shaft bindings there may be achieved in general only weft counts which are four-fifths of the current number of the warp threads. Contrastingly, in an atlas binding there can be obtained a weft count without great difficulties which is substantially higher and which can be equal to the number of the warp threads. There is thus afforded the possibility of a further improvement in the stability when employed as a warp runner, and respectively, in the operating or circulating time when employed as a weft runner.

What is claimed is:

1. In combination with a paper making machine having a wet paper processing end section, a water-permeable screen located in said machine wet end section and facilitating the wet batching or passage of said wet paper through that section of the machine, said screen being constituted of plastic monofilament warp and weft threads woven into at least a five-shed binding having uniformly distributed binding points, said binding points being spaced and not touching each other, and said screen having the weft counts thereof higher than four-fifths of the current number of the warp threads.

2. The combination as claimed in claim 1, comprising a fluorocarbon coating being provided on said screen.

3. The combination as claimed in claim 1, said screen having a paper-supporting side, the uppermost points of said warp and weft threads in the direction towards said side being located in essentially a single plane.

* * * * *

REEXAMINATION CERTIFICATE (459th)

United States Patent [19]

Wandel et al.

[11] B1 4,157,276

[45] Certificate Issued Feb. 11, 1986

[54] PAPER MACHINE FABRIC IN AN ATLAS BINDING

[75] Inventors: Hermann Wandel; Fritz Bleher, both of Reutlingen, Fed. Rep. of Germany

[73] Assignee: Hermann Wangner, Reutlingen, Fed. Rep. of Germany

Reexamination Reqs:st:

No. 90/000,451, Sep. 30, 1983
No. 90/000,486, Jan. 16, 1984

Reexamination Certificate for:

Patent No.: 4,157,276
Issued: Jun. 5, 1979
Appl. No.: 674,817
Filed: Apr. 8, 1976

[30] Foreign Application Priority Data

Apr. 18, 1975 [DE] Fed. Rep. of Germany ..... 2517228

[51] Int. Cl.[4] ..... D21F 1/10

[52] U.S. Cl. ..... 162/348; 139/425 A; 162/DIG. 1; 428/258

[58] Field of Search ..... 162/348, DIG. 1; 139/425 A; 428/257, 258

[56] References Cited

U.S. PATENT DOCUMENTS

| | | | |
|---|---|---|---|
| 1,616,222 | 2/1927 | Harrigan | 162/348 |
| 1,927,498 | 9/1933 | Lindsay et al. | 139/425 |
| 2,542,297 | 2/1951 | Sunbury et al. | 139/420 |
| 3,143,150 | 8/1964 | Buchanan | 139/425 |
| 3,211,606 | 10/1965 | Watson | 162/348 |
| 3,214,326 | 10/1965 | Lee | 162/205 |
| 3,214,330 | 10/1965 | Wicker et al. | 162/358 |
| 3,421,230 | 1/1969 | Ward | 139/425 A |
| 3,603,354 | 9/1971 | Lee et al. | 139/383 |
| 3,632,068 | 1/1972 | Weir et al. | 245/8 |
| 3,858,623 | 1/1975 | Lefkowitz | 139/425 A |
| 3,915,202 | 10/1975 | Curtis et al. | 139/425 A |

FOREIGN PATENT DOCUMENTS

| | | |
|---|---|---|
| 4207764 | 9/1965 | Australia . |
| 53926 | 1/1943 | Netherlands . |

OTHER PUBLICATIONS

Nordiskafilt *Standard Weave Designs,* pp. 1–11, Mar. 1968.

"Gewebebindungen," DIN 61101, Deutsche Norm, May 1946, pp. 1–4.

Donat, "Die Theorie der Weberei," Ulfred Sölder, Weins, 1913, pp. 34–37.

Bolam (editor), "Monographs in Paper and Board Making", Ernest Been Limited (London), 1974, pp. VI, 46–47, 52–53, 72–73.

"Drahtgewebe-Tabellen", Gebr. Kufferath, 1970, cover pg., & p. 7, with German opposition and translation.

Thomas, "Betrachtung uber die Herstellung von Papiermaschinensieben", Deutsche Textiltechnik 8, 1958, pp. 593–595 with 2 translations.

"These are the Gusum Synthetic Fourdrinier Wires", Gusum Brochure, pp. 29–31, Feb., 1972, in English and German languages.

Schreus, "Filtergewebe", Die Muhle, p. 692, FIG. 7; Nov. 22, 1956.

Engel, "Neue Erkenntnisse beider Webfilzherstellung und Verwendung", Zellstoff und Papier, pp. 171–175; Jun., 1963.

Keim, "Sieb und Filz", pp. 19, 21 and 57; Biberach/Riss (Warttemberg) 1968.

Oelsner, "A Handbook of Weaves", Dover Publications, Inc. (New York), 1952, Face sheet, pp. V & 26–31.

Haver & Boecker Brochure, "Wire Cloth from Five Inch to Five Micron Aperture/Woven Wire Cloth, 1966.

*Primary Examiner*—S. Leon Bashore

[57] ABSTRACT

A fabric for a paper machine including warp and weft threads in an atlas binding providing for improved longitudinal and transverse stability. The uppermost points of the warp and weft threads in the direction towards a paper-supporting surface on the fabric are located in substantially a single plane so as to obtain more uniform marking properties for the fabric and to concurrently avoid material deposits thereon.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 26–46:

1. Cotton-wadding papers on tissue machines.

Herein, in view of the more uniform fabric construction, in actual practice there can be attained operating speeds of 1150 meters per minute. However, this speed does not represent an upper limit; in particular in the employment as a weft atlas (warp runner) it is possible to attain still higher operating speeds. [2. Printing papers and generally types of papers in which the marking through twin formation results in an inherent disadvantage.

Inasmuch as, for synthetic fabrics, the twinning or marking effect is obviated in an atlas binding a further field of application can thereby be ascertained for synthetic fabrics when, through a satisfactory combination of warp and weft thread diameters, there is provided an optimum compromise between stability and marking. This possibility results from the fact that at the same drainage capacity or dehydrating output, the weft density can be increased and the marking improved.]

2. [3.] Packing papers (Kraft and test liners and corrugated medium).

AS A RESULT OF REEXAMINATION, IT HAS BEEN DETERMINED THAT:

Claim 1 is cancelled.

Claims 2 and 3 are determined to be patentable as amended.

New claim 4 is added and determined to be patentable.

2. The combination as claimed in claim [1] *4*, comprising a fluorocarbon coating being provided on said screen.

3. The combination as claimed in claim [1] *4*, said screen having a paper-supporting side, the uppermost points of said warp and weft threads in the direction towards said side being located in essentially a single plane.

*4. In combination with a tissue paper-making machine having a wet end paper-processing section, a water-permeable forming screen located in said machine wet end section and facilitating the wet batching or forming of said wet paper in that section of the machine, said screen comprising:*

*(a) a plurality of plastic monofilament warp and weft threads, said threads imparting a high longitudinal and transverse stability to said screen;*

*(b) said threads woven in at least a 5-shed binding having uniformly distributed binding points, and binding points being spaced and not touching each other;*

*(c) said warp threads running in the longitudinal direction of the screen with the weft threads running in the transverse direction;*

*(d) said screen when used having weft counts thereof higher than 4/5ths of the current number of warp thread, and*

*(e) said screen being a warp runner.*

* * * * *